US008230537B2

(12) United States Patent
Stewart et al.

(10) Patent No.: US 8,230,537 B2
(45) Date of Patent: Jul. 31, 2012

(54) BEDDING TOP COVER WITH SIMULATED BED SCARF

(75) Inventors: Richard Stewart, Mason, OH (US); Saravan Muthanandam, Loveland, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 475 days.

(21) Appl. No.: 12/509,134

(22) Filed: Jul. 24, 2009

(65) Prior Publication Data

US 2011/0016631 A1 Jan. 27, 2011

(51) Int. Cl.
*A47G 9/02* (2006.01)
*D03D 25/00* (2006.01)

(52) U.S. Cl. ..... 5/501; 5/482; 139/383 R

(58) Field of Classification Search ..... 5/501, 486, 5/482, 495; 139/417, 416, 383 R
See application file for complete search history.

(56) References Cited

U.S. PATENT DOCUMENTS

| | | | |
|---|---|---|---|
| 708,109 | A | 9/1902 | Williams |
| 835,083 | A | 11/1906 | Strahl |
| 992,101 | A | 5/1911 | Adams |
| 1,267,042 | A | 5/1918 | Arnold |
| 1,907,393 | A | 5/1933 | Tooley |
| 2,059,092 | A | 10/1936 | Donovan |
| 2,059,096 | A | 10/1936 | Goodchild |
| 2,262,436 | A | 11/1941 | Cotton |
| 2,262,463 | A | 11/1941 | Marr |
| 2,272,229 | A | 2/1942 | Tucker |
| 2,546,831 | A | 3/1951 | Newell |
| 2,610,336 | A | 9/1952 | Schworm |
| 2,738,746 | A | 3/1956 | MacIssac, Jr. |
| 3,120,721 | A | 2/1964 | Bukatman et al. |
| 3,241,161 | A | 3/1966 | Dashosh |
| 3,273,176 | A | 9/1966 | Millar |
| 3,331,088 | A | 7/1967 | Marquette |
| 3,477,397 | A | 11/1969 | Hawley |
| 3,489,113 | A | 1/1970 | Flanagan |
| 3,508,284 | A | 4/1970 | Marquette |
| 3,580,198 | A | 5/1971 | Teed et al. |
| 3,926,227 | A | 12/1975 | Takada et al. |

(Continued)

FOREIGN PATENT DOCUMENTS

FR 2103903 A5 4/1972

(Continued)

OTHER PUBLICATIONS

Extended European Search Report from counterpart European Application No. 09171616.7 mailed Nov. 25, 2010 (7 pages).

*Primary Examiner* — Robert G Santos
(74) *Attorney, Agent, or Firm* — Wood, Herron & Evans, LLP

(57) ABSTRACT

A bedding top cover that defines a woven fabric that is ordinarily white or substantially white in color and has an alternate colored, textured, and/or patterned area or band purposefully located near the foot end of the bedding top cover and which is woven, via colored, textured, and/or patterned yarns, integrally with the top cover fabric. This simulated alternate colored, textured, and/or patterned area appears in many respects to be a bed scarf and serves the same aesthetic and protective functions of a separate piece of fabric. In one example, the simulated bed scarf is multicolored and the remainder of the bedding top cover is white.

20 Claims, 3 Drawing Sheets

U.S. PATENT DOCUMENTS

| | | | | |
|---|---|---|---|---|
| 4,021,869 | A | | 5/1977 | Root |
| 4,128,686 | A | | 12/1978 | Kyle et al. |
| 4,191,221 | A | | 3/1980 | Boyer |
| 4,269,130 | A | | 5/1981 | Burton et al. |
| 4,271,767 | A | | 6/1981 | Burton et al. |
| 4,287,841 | A | | 9/1981 | Rovin |
| 4,312,285 | A | | 1/1982 | Ketterer |
| 4,384,381 | A | | 5/1983 | Lowthian |
| 4,473,373 | A | | 9/1984 | Weiss |
| 4,802,250 | A | | 2/1989 | Farr |
| 4,875,245 | A | | 10/1989 | Isola |
| 4,903,360 | A | | 2/1990 | Friedman |
| 4,934,939 | A | | 6/1990 | Bonneville |
| 5,007,125 | A | | 4/1991 | Owenby |
| 5,118,553 | A | | 6/1992 | Boisson |
| 5,208,926 | A | | 5/1993 | Stackhouse |
| 5,240,758 | A | | 8/1993 | Honigberg |
| 5,251,350 | A | | 10/1993 | Bordenave, Sr. et al. |
| 5,287,573 | A | | 2/1994 | Ritacco |
| 5,321,861 | A | | 6/1994 | Dancey et al. |
| 5,424,117 | A | | 6/1995 | Heiman et al. |
| 5,487,936 | A | | 1/1996 | Collier |
| 5,513,403 | A | | 5/1996 | Wooten, Jr. |
| 5,655,236 | A | | 8/1997 | Murray |
| 5,697,329 | A | | 12/1997 | Bell et al. |
| 5,713,089 | A | | 2/1998 | Ferrante |
| 5,807,794 | A | | 9/1998 | Knox et al. |
| 5,836,023 | A | | 11/1998 | Stone Munson |
| 5,855,991 | A | | 1/1999 | McLarty, III |
| D405,529 | S | * | 2/1999 | Walker et al. ..... D24/189 |
| 5,913,277 | A | | 6/1999 | Resta |
| D422,363 | S | * | 4/2000 | Walker et al. ..... D24/189 |
| D422,708 | S | * | 4/2000 | Walker et al. ..... D24/189 |
| 6,052,846 | A | | 4/2000 | Patel et al. |
| 6,105,186 | A | | 8/2000 | Stone Munson |
| 6,148,458 | A | | 11/2000 | Hires |
| 6,216,292 | B1 | | 4/2001 | Oakhill et al. |
| 6,230,341 | B1 | | 5/2001 | Dudley |
| 6,263,816 | B1 | | 7/2001 | Codos et al. |
| 6,557,192 | B2 | | 5/2003 | Zheng |
| 6,772,530 | B2 | | 8/2004 | Nennig |
| 6,845,532 | B1 | | 1/2005 | Rosenblum |
| 7,017,207 | B2 | | 3/2006 | Lauderman |
| 7,316,039 | B2 | | 1/2008 | Wootten, Jr. |
| 7,530,124 | B1 | | 5/2009 | Wootten, Jr. |
| 7,562,404 | B2 | | 7/2009 | Wootten, Jr. |
| 7,565,707 | B2 | | 7/2009 | Wootten, Jr. |
| 2004/0031098 | A1 | | 2/2004 | Hollander |
| 2005/0132493 | A1 | * | 6/2005 | Lauderman ..... 5/495 |
| 2005/0273930 | A1 | | 12/2005 | Phillipps |
| 2007/0044861 | A1 | * | 3/2007 | Stewart et al. ..... 139/383 R |
| 2007/0062597 | A1 | * | 3/2007 | Stewart et al. ..... 139/383 A |
| 2007/0169264 | A1 | | 7/2007 | Spicer et al. |
| 2009/0193584 | A1 | * | 8/2009 | Stewart et al. ..... 5/495 |
| 2010/0146701 | A1 | | 6/2010 | Bhuta |
| 2011/0016631 | A1 | * | 1/2011 | Stewart et al. ..... 5/501 |

FOREIGN PATENT DOCUMENTS

| | | | |
|---|---|---|---|
| FR | 2214439 | A1 | 8/1974 |
| WO | 9119443 | A1 | 12/1991 |

* cited by examiner

BEDDING TOP COVER WITH SIMULATED BED SCARF

FIELD OF THE INVENTION

The present invention relates to bedding products and, more particularly, to a bedding top cover.

BACKGROUND OF THE INVENTION

In many hotels, a made-up bed generally consists of white, or light-colored, linens and a bed covering, such as a bedspread, as the uppermost layer. These bedspreads often feature multicolor fabrics and/or patterns that serve a decorative function. Due to their coloration and patterns, bedspreads also generally tend to hide dirt and stains. As a consequence, bedspreads have the added benefit of protecting the linens thereunder from incidental soiling or staining that might otherwise occur when dirty items, such as luggage or shoes, are placed on the made-up bed, typically near the foot end, as is oftentimes done.

Some hotels have converted to an all, or substantially all, white heavyweight woven sheeting or "top cover" as a replacement for the bedspread. However, while arguably improving the general appearance and perceived quality of the bedding, these top covers are themselves prone to noticeable soiling or staining from luggage and shoes, for example. Accordingly, many hotels find it necessary to add a separate cover over an area of the top cover on which patrons typically place their luggage and/or shoes, to provide a "landing zone" extending across the width of the top cover near the foot end of the bed. One type of cover used for that purpose is a bed scarf (also referred to as a throw) which is a narrow piece of fabric, but sized so that while it extends across the made-up bed over the top cover, it extends laterally over only a short distance near the foot of the bed in the area most prone to receive luggage and shoes. Accordingly, the bed scarf is an added component that serves as a decorative accent like a bedspread, but also serves as a landing zone for luggage and other such items that might commonly be placed on the made-up bed and might otherwise soil or stain the top cover.

The addition of the bed scarf, while advantageous to protect the top cover and add aesthetically to the appearance of the made-up bed, nonetheless presents a number of drawbacks. For example, bed scarves can be considerably more expensive than the top cover itself. Bed scarves may also separately require dry cleaning or introduce complications in laundry processing, and introduce an additional step in the bed making process. Moreover, owing to their relatively small size, bed scarves can be prone to pilferage.

SUMMARY OF THE INVENTION

The present invention provides a bedding top cover that aims at reducing or eliminating the need for a separate bed scarf while still providing a decorative and protective feature to the "landing zone" area of the top cover. To that end and in accordance with the principles of the present invention, the bedding top cover defines a continuous length of woven fabric formed with an integral band near the bottom edge thereof in the general area of the typical landing zone but having a different appearance from the rest of the top cover so as to simulate a bed scarf in appearance, but having thermal characteristics generally the same as the rest of the top cover so that the bed scarf does not create discomfort for a user situated under the top cover. The top cover is sized for uppermost placement over a made-up bed mattress so that the simulated bed scarf is situated adjacent to, or near, the foot of a bed mattress when the fabric is placed thereover. The simulated bed scarf has a color, texture, and/or pattern that is different from the remaining areas of the fabric. And such alternate colored, textured, and/or patterned area appears in many respects to be a bed scarf and serves the same aesthetic and protective functions of a separate piece of fabric, but is more economical and saves on bed making labor, as well as facilitating simpler and less expensive laundry processing. And although the simulated bed scarf provides a distinct colored, textured, and/or patterned area, the fabric maintains a generally uniform thermal characteristic throughout. That is, the heat transfer through the fabric does not vary significantly from one area to another. By way of example, the colored, textured, and/or patterned band fails to provide any greater warmth to the lower extremities if used as a covering while sleeping, which can be uncomfortable to the user.

By virtue of the foregoing, there is thus provided a bedding top cover that aims at reducing or eliminating the need for a separate bed scarf while still providing a decorative and protective feature to the "landing zone" area of the top cover. These and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate an embodiment of the invention and together with the general description of the invention given above and the detailed description of the embodiment given below, serve to explain the principles of the present invention.

DETAILED DESCRIPTION OF THE DRAWINGS

Figure 1:
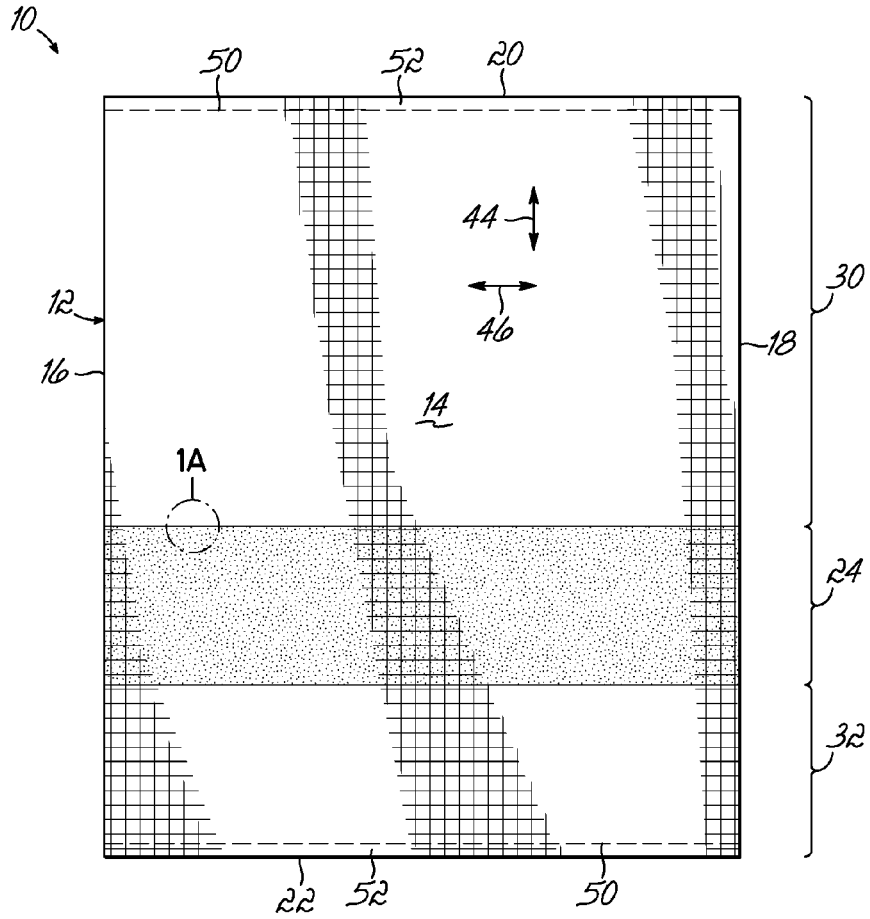
FIG. 1 is a top plan view of a bedding top cover with simulated bed scarf in accordance with the principles of the present invention.
Figure 2:
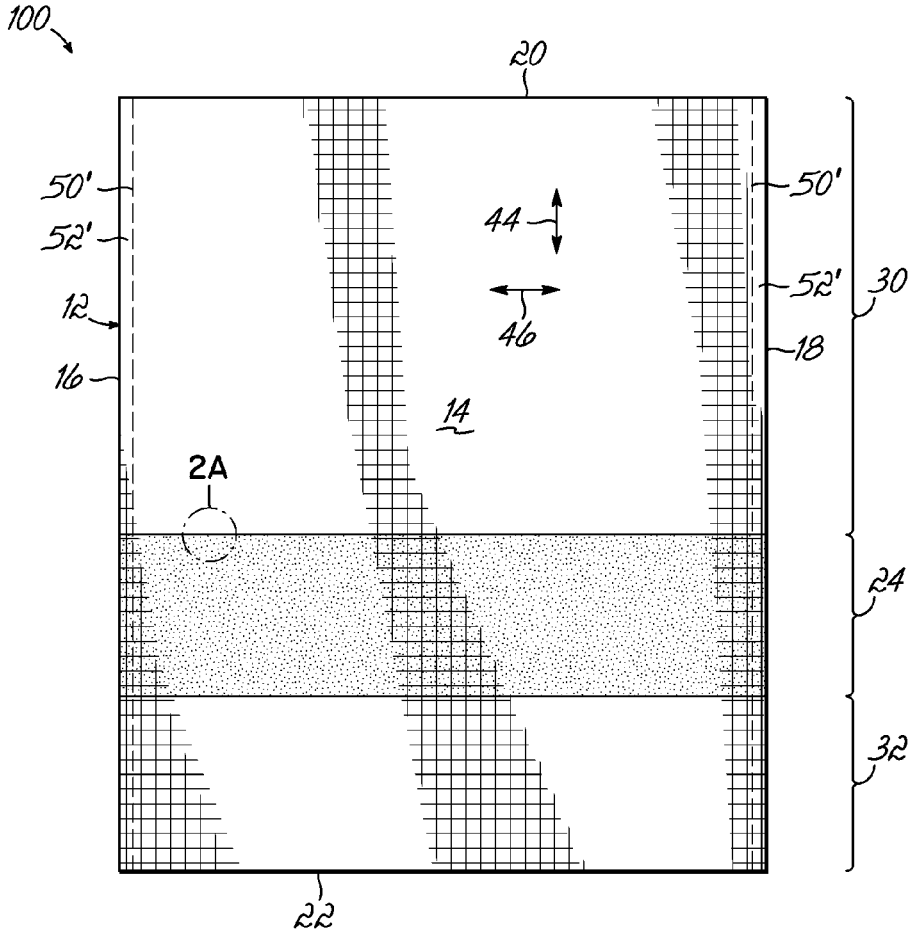
FIG. 2 is a top plan view of an alternate embodiment of a bedding top cover with simulated bed scarf in accordance with the principles of the present invention.
Figure 2A:
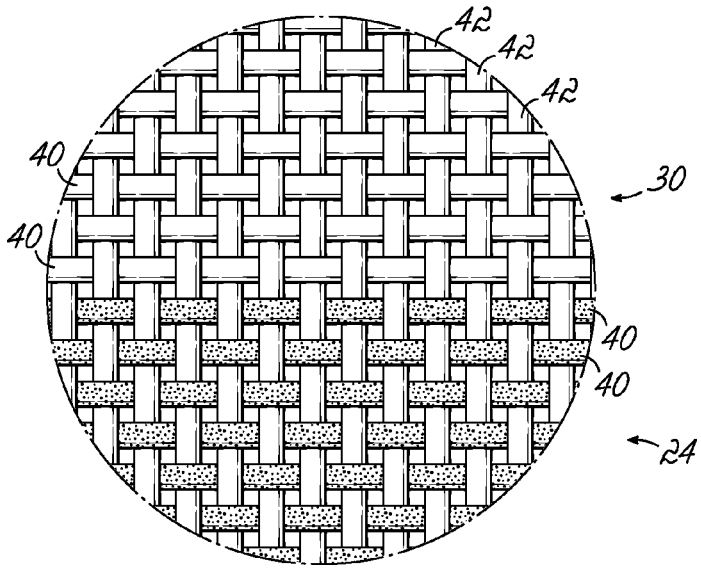
FIG. 2A is an enlarged, fragmentary top plan view, not to scale, of the bedding top cover with simulated bed scarf of FIG. 2.
Figure 3:
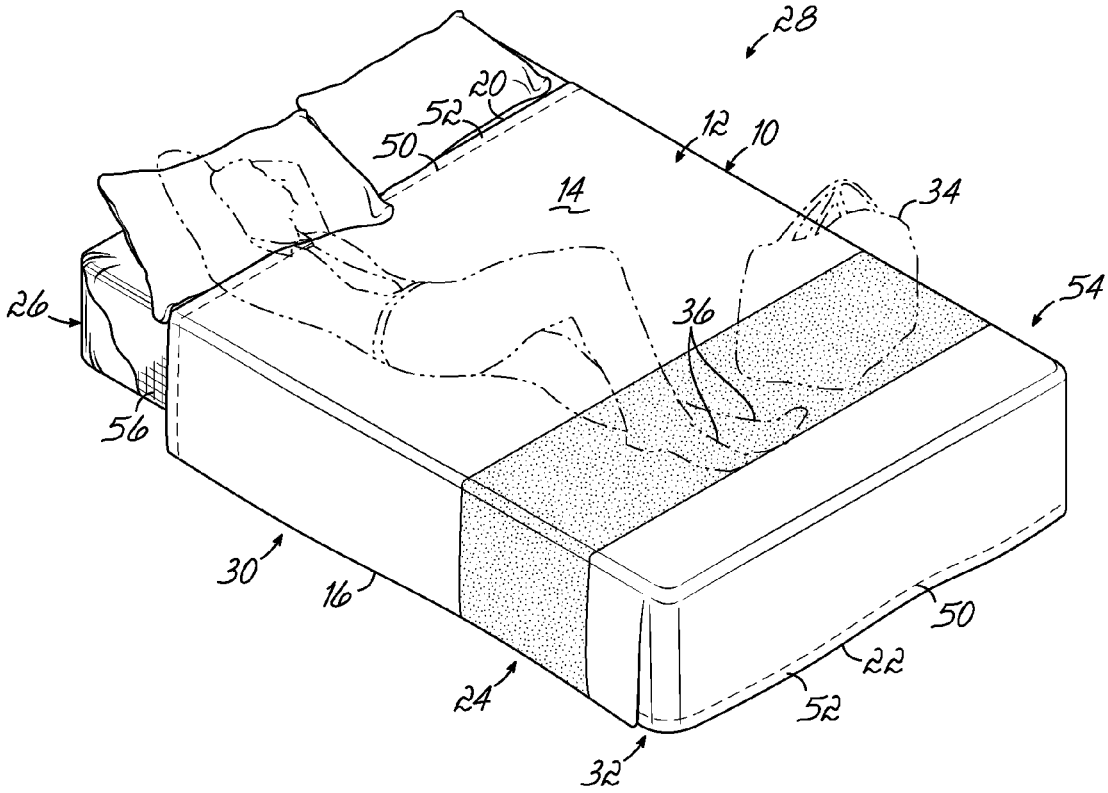
FIG. 3 is a perspective view of the bedding top cover with simulated bed scarf of FIG. 1 situated on a bed.

With reference to FIGS. 1-2A, a bedding top cover 10, 100, in accordance with the principles of the present invention, includes a rectangular, continuous length of woven fabric 12 that has a field portion 14 extending widthwise between opposite left 16 and right 18 side edges and lengthwise between opposite top 20 and bottom 22 edges. Fabric 12 includes an integral band 24 extending between side edges 16 and 18 and spaced near bottom edge 22 in the "landing zone" area of fabric 12 when placed over a mattress 26 of a made-up bed 28 (FIG. 3). Band 24 presents a visually different appearance from the rest of fabric 12 in the areas 30 and 32 defined between band 24 and edges 20 and 22, respectively, the latter typically being white or other light color. To that end, band 24 provides the appearance of a bed scarf so as to generally hide soiling and staining from dirty or heavy items, such as luggage 34 or shoes 36 (FIG. 3), that might be tossed onto the made-up bed 28. Hence, band 24 defines a simulated bed scarf.

Despite the difference in appearance of band 24 from the rest of fabric 12 in areas 30 and 32, the fabric 12 maintains a generally uniform thermal characteristic throughout. That is, the heat transfer through the bedding top cover 10 does not vary significantly from one area 30, 32, 24 of the bedding top cover 10 to another. This can be generally attributed to relatively even spacing and even densities of the woven yarns, i.e., warp ends 40 and fill picks 42, which remains essentially constant throughout the fabric 12. As a result, band 24 fails to provide any noticeably greater warmth to the lower extremities, for example, if the bedding top cover 10 is used by an individual as a covering while sleeping.

Figure 1A:
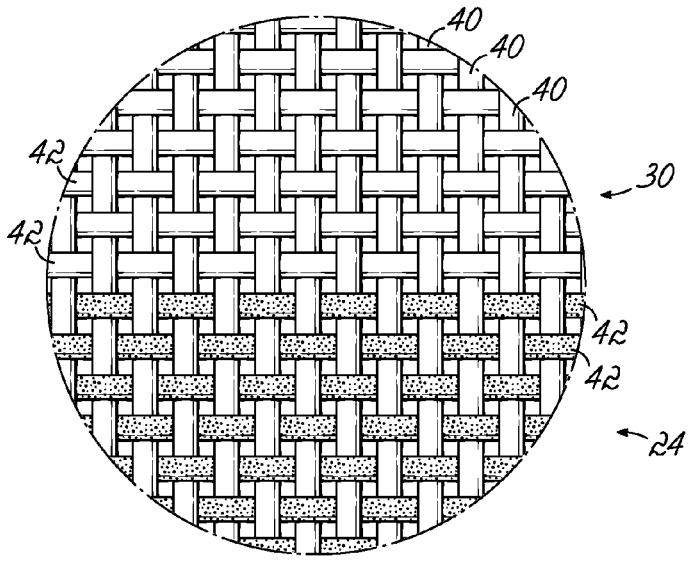
FIG. 1A is an enlarged, fragmentary top plan view, not to scale, of the bedding top cover with simulated bed scarf of FIG. 1.

With specific reference now to FIGS. 1 and 1A, the woven fabric 12, in one embodiment, is defined by a one-ply woven web of warp ends 40 and fill picks 42. In particular, the length of woven fabric 12 has been originally woven and cut so that the warp ends 40 define the lengthwise direction 44 and the fill picks 42 define the widthwise direction 46 of woven fabric 12. Accordingly, the warp ends 40 and fill picks 42 extend through the woven fabric 12 in the lengthwise direction 44 and the widthwise direction 46, respectively. A seam 50 runs widthwise across the fabric 12 adjacent both the top and bottom edges 20, 22 to form a hem 52 thereat.

The woven fabric 12, as has been generally discussed above, is divided into three, integrally woven areas or bands 30, 32, and 24 along its length. The first area 30 extends from the top edge 20 toward the bottom edge 22 and from the left side edge 16 to the right side edge 18. The second area 32 extends from the bottom edge 22 toward the top edge 20 and from the left side edge 16 to the right side edge 18. And the third area 24 extends between the first and second areas 30, 32 and from the left side edge 16 to the right side edge 18. The areas 30, 32, 24 are sized such that the third area 24 is spaced near the bottom edge 22 so as to be situated near the foot 54 of the bed 28 having a made-up bed mattress 26 over which the fabric 12 is to be placed, as shown in FIG. 3 and discussed in more detail further below. The third area 24 is sized to be no less than 12 inches and no greater than 36 inches, and advantageously about 24 inches, in length so as to accommodate luggage 34 (FIG. 3) or the like that may be placed thereon when the bed 28 is made-up.

With continuing reference to FIGS. 1 and 1A, the third area 24 includes a plurality of fill picks 42 that are different in color from the fill picks 42 of the first and second areas 30, 32 and from the warp ends 40 of the fabric 12 so that the third area 24 defines a band that provides the illusion of, i.e., simulates, a bed scarf. While the fill picks 42 in the third area 24 are shown as being different in color, the fill picks 42 alternately or additionally may be textured and/or patterned differently from the fill picks 42 of the first and second areas 30, 32 and from the warp ends 40 of the fabric 12 so as to define or help define the simulated bed scarf. In addition, while the warp ends 40 and fill picks 42 of the first and second area 30, 32 are shown having a generally consistent color, texture, and pattern throughout, it is contemplated that the color, texture, and/or pattern may be varied therein or therebetween.

With respect to color, the warp ends 40 of the fabric 12 and the fill picks 42 in the first and second areas 30, 32 are generally white, and the fill picks 42 in the third area 24 are other than generally white, advantageously each is space dyed, i.e., multicolored, so as to define the simulated bed scarf. As will be appreciated by one of ordinary skill in the art, the colors for the warp ends 40 and fill picks 42, as well as any textures and patterns thereof are essentially boundless. To that end, the fill picks 42 of the third area 24, individually or collectively, may be any generally non-white color, mixture, or blend thereof, and the fill picks 42 in the first and second areas 30, 32, and the warp yarns 24, individually or collectively, may be any color, mixture, or blend thereof so long as the third area 24 simulates a bed scarf, and such simulated bed scarf affords a desirable level of soiling protection to the remainder of the top cover 10 and, to a desirable degree, hides dirt and stains from items that are dirty, such as luggage 34 or shoes 36 (FIG. 3), when placed thereon.

With respect to patterning, while a 1×1 weave pattern is shown throughout the fabric 12, as will be appreciated by one of ordinary skill in the art, many different patterns may be utilized in the fabric 12, particularly the third area 24, such as to simulate a bed scarf. For example, one or more, or all, areas 30, 32, 24 of the fabric 12, may be formed using a twill weave, a satin weave, a gabardine weave, a herringbone weave, or a combination of such weaves. In addition, any suitable yarn float pattern may be used. Nonlimiting examples include a 2/1 twill weave pattern, a 2/2 twill weave pattern, and a 4/1 satin weave pattern, although other float patterns and weaves with floated yarns are possible.

The fill picks 42 and warp ends 40 may be formed of natural fibers, synthetic staple fibers, synthetic filaments, combinations, or blends thereof. In one example, the fill picks 42 of the third area 24 are synthetic multifilament yarns, advantageously, polyester yarns. In another example, the fill picks 42 and warp ends 40 of the entire fabric 12 are synthetic multifilament yarns, advantageously, polyester yarns. And, as will be appreciated by one of ordinary skill in the art, many different types of textured yarns formed via known texturing techniques may be used as the warp ends 40 and/or fill picks 42 in the fabric 12, particularly the fill picks 42 in the third area 24, such as to simulate the bed scarf. It should be understood that textured yarns can create different surface textures and provide different looks to the fabric 12 including, for example, a dull, lustrous, or wooly look. And despite a differentiation in color, pattern, and/or texture between the third area 24 and the first and second areas 40, 42, as discussed above, the fabric 12 of the bedding top cover 10 maintains a generally uniform thermal characteristic throughout.

With reference now to FIGS. 2 and 2A and in accordance with another embodiment of the present invention, a bedding top cover 100 is shown having an integral band 24 simulating a bed scarf. The main differences between bedding top cover 10 of FIGS. 1 and 1A and bedding top cover 100 of FIGS. 2 and 2A are discussed next.

As shown in FIGS. 2 and 2A, the length of woven fabric 12 of bedding top cover 100 has been originally woven and cut so that the warp ends 40 define the widthwise direction 46 and the fill picks 42 define the lengthwise direction 44 of woven fabric 12. Accordingly, the warp ends 40 and fill picks 42 extend through the woven fabric 12 in the widthwise direction 46 and the lengthwise direction 44, respectively. As a result and as will be appreciated by one of ordinary skill in the art, a seam 50' runs lengthwise across the fabric 12 adjacent both the left and right side edges 16, 18 to form a hem 52' thereat, and the warp ends 40, rather than the fill picks 42, of the third area 24 are different in color from the warp ends 40 of the first and second areas 30, 32 and from the fill picks 42 of the fabric 12 so that the third area 24 provides the illusion of, i.e., simulates, a bed scarf. Similarly, while the warp ends 40 in the third area 24 are shown as being different in color, the warp ends 40 alternately or additionally may be textured and/or patterned differently from the warp ends 40 of the first and second areas 30, 32 and from the fill picks 42 of the fabric 12 so as to define or help define the simulated bed scarf, just like the fill picks 42 of the third area 24 in FIGS. 1 and 1A.

With reference now to FIG. 3, the bedding top cover 10, 100 (only top cover 10 is shown) with simulated bed scarf is sized for uppermost placement over made-up bed mattress 26. To that end, to complete the make-up of bed 28, the bedding top cover 10 is placed over bed linens 56 on mattress 26 so that the third area 24, or simulated bed scarf, is situated near the foot 54 of the made-up bed 28, advantageously about 12 inches from the foot 54 of the bed 28, to hide dirt and stains as well as afford a desirable amount of soiling protection to the bed linens 56 and the rest of the top cover 10 that might otherwise occur when items that are dirty, such as luggage 34 or shoes 36, are placed on the made-up bed 28. In one example, the third area 24 is spaced about 26 inches from the bottom edge 18. While the third area 24 is situated greater than 12 inches from the bottom edge 18 of the top cover 10 so as to be about 12 inches from the foot 54 of the made-up bed 28, it will be appreciated by those skilled in the art that the distances from the bottom edge 18 will vary based on whether the top cover 10 is to be draped over the bed 28 or tucked in.

By virtue of the foregoing, there is thus provided a bedding top cover 10, 100 that aims at reducing or eliminating the need for a separate bed scarf while still providing a decorative and protective feature to the "landing zone" area of the top cover, but without the above-discussed drawbacks.

While the present invention has been illustrated by the description of an embodiment thereof, and while the embodiment has been described in considerable detail, it is not intended to restrict or in any way limit the scope of the appended claims to such detail. Additional advantages and modifications will readily appear to those skilled in the art. For example, rather than differentiate color, pattern, and/or texture of the yarn in the third area of the fabric to simulate a bed scarf, a decorative fabric may be attached widthwise directly to the top side thereof by means of sewing or lamination to simulate a bed scarf. This has the advantage of facilitating bed make-up and decreases the likelihood of pilferage of individual bed scarves but also may create higher fabrication costs and potential issues with differential shrinkage between the top cover base fabric and the attached decorative scarf fabric. The invention in its broader aspects is, therefore, not limited to the specific detail, representative apparatus and methods and illustrative examples shown and described. Accordingly, departures may be made from such details without departing from the spirit or scope of the general inventive concept.

What is claimed:

1. A bedding top cover for use on a bed mattress made up with linens, the bed mattress having a head portion and a foot portion, the bedding top cover comprising:

a continuous length of woven fabric including a top edge, a bottom edge, a left side edge, and a right side edge, the fabric being sized for uppermost placement over a made-up bed mattress with the top edge being situated near the head portion of the mattress and the bottom edge being situated near the foot portion of the mattress, the fabric having three, integrally woven areas, a first area extending from the top edge toward the bottom edge, a second area extending from the bottom edge toward the top edge, and a third area extending between the first and second areas and from the left side edge to the right side edge, the areas being sized such that the third area is spaced near the bottom edge so as to be situated near the foot portion of the bed mattress when the fabric is placed thereover, the third area having a color, texture, and/or pattern that is different from the first and second areas so as to simulate a bed scarf, the fabric having a generally uniform thermal characteristic throughout, the third area being spaced greater than 12 inches from the bottom edge of the fabric and the third area being no less than 12 inches and no greater than 36 inches in length so as to define a landing zone area over top of the made-up bed mattress near the foot portion of the bed mattress.

2. The bedding top cover of claim 1, the fabric having warp ends and fill picks woven together, the warp ends extending between the top and bottom edges and the fill picks extending between the left and right side edges.

3. The bedding top cover of claim 2, the third area being different in color from the first and second areas so as to define the simulated bed scarf.

4. The bedding top cover of claim 3, the warp ends being generally white and the fill picks in the first and second areas being generally white, the fill picks in the third area being other than generally white.

5. The bedding top cover of claim 4 wherein a plurality of the fill picks in the third area is multi-colored.

6. The bedding top cover of claim 3 wherein the fill picks in the third area are synthetic multifilament yarns.

7. The bedding top cover of claim 6 wherein the synthetic multifilament yarns are polyester.

8. The bedding top cover of claim 1 wherein the first and second areas have a generally consistent color, texture, and pattern throughout.

9. The bedding top cover of claim 1, the fabric having warp ends and fill picks woven together, the fill picks extending between the top and bottom edges and the warp ends extending between the left and right side edges.

10. A method of protecting a bedding top cover from placement of luggage thereon comprising:

incorporating a bed scarf into the bedding top cover by weaving warp ends and fill picks together to define a continuous length of woven fabric including a top edge, a bottom edge, a left side edge, and a right side edge, the fabric sized for uppermost placement over a made-up bed mattress with the top edge being situated near a head portion of the mattress and the bottom edge being situated near a foot portion of the mattress and having three, integrally woven areas, a first area extending from the top edge toward the bottom edge, a second area extending from the bottom edge toward the top edge, and a third area extending between the first and second areas and from the left side edge to the right side edge, the areas sized such that the third area is spaced near the bottom edge so as to be situated near the foot portion of the bed mattress over which the fabric is placed and to define a landing zone area over top of the bed mattress near the foot portion thereof, the third area having a color, texture, and/or pattern that is different from the first and second areas so as to simulate a bed scarf, the fabric having a generally uniform thermal characteristic throughout.

11. The method of claim 1, the warp ends extending between the top and bottom edges and the fill picks extending between the left and right side edges.

12. The method of claim 11, the third area being different in color from the first and second areas so as to define the simulated bed scarf.

13. The method of claim 12, the warp ends being generally white and the fill picks in the first and second areas being generally white, the fill picks in the third area being other than generally white.

14. The method of claim 13 wherein a plurality of the fill picks in the third area is multi-colored.

15. The method of claim 12 wherein the fill picks in the third area are synthetic multifilament yarns.

16. The method of claim 15 wherein the synthetic multifilament yarns are polyester.

17. The method of claim 10 wherein the first and second areas have a generally consistent color, texture, and pattern throughout.

18. The method of claim 10 wherein the third area is spaced greater than 12 inches from the bottom edge of the fabric and the third area is no less than 12 inches and no greater than 36 inches in length.

19. The method of claim 10, the fill picks extending between the top and bottom edges and the warp ends extending between the left and right side edges.

20. The method of claim 10 further comprising placing the bedding top cover over a bed mattress made up with linens with the third area situated near the foot of the mattress with the landing zone area over top of the made-up bed mattress near the foot portion thereof.

* * * * *

UNITED STATES PATENT AND TRADEMARK OFFICE

CERTIFICATE OF CORRECTION

PATENT NO. : 8,230,537 B2
APPLICATION NO. : 12/509134
DATED : July 31, 2012
INVENTOR(S) : Richard Stewart et al.

It is certified that error appears in the above-identified patent and that said Letters Patent is hereby corrected as shown below:

Claim 11, Column 6, line 56, "The method of claim 1" should be -- The method of claim 10 --

Signed and Sealed this
Ninth Day of October, 2012

David J. Kappos

David J. Kappos
*Director of the United States Patent and Trademark Office*